US008357867B2

(12) United States Patent
Soininen et al.

(10) Patent No.: US 8,357,867 B2
(45) **Date of Patent: *Jan. 22, 2013**

(54) CONTROLLER UNIT FOR SWITCHING DEVICE

(75) Inventors: Matti Soininen, Jukaja (FI); Aki Suutarinen, Vaasa (FI)

(73) Assignee: ABB Oy, Helsinki (FI)

( * ) Notice: Subject to any disclaimer, the term of this patent is extended or adjusted under 35 U.S.C. 154(b) by 102 days.

This patent is subject to a terminal disclaimer.

(21) Appl. No.: 12/971,833

(22) Filed: Dec. 17, 2010

(65) Prior Publication Data

US 2011/0147184 A1 Jun. 23, 2011

Related U.S. Application Data

(63) Continuation of application No. PCT/FI2009/050514, filed on Jun. 12, 2009.

(51) Int. Cl.
*H01H 3/08* (2006.01)

(52) U.S. Cl. ..... 200/336

(58) Field of Classification Search ..... 200/400, 200/336, 329, 50.21, 17 R, 50.32
See application file for complete search history.

(56) References Cited

U.S. PATENT DOCUMENTS

| | | | | |
|---|---|---|---|---|
| 2,797,591 | A | 7/1957 | Marrapese | |
| 5,438,176 | A * | 8/1995 | Bonnardel et al. | 200/400 |
| 5,886,311 | A | 3/1999 | Morel et al. | |
| 6,501,039 | B1 | 12/2002 | Mattlar et al. | |
| 6,940,032 | B2 * | 9/2005 | Sirajtheen et al. | 200/400 |
| 7,566,840 | B2 * | 7/2009 | Sudhakar et al. | 200/244 |
| 2007/0131528 | A1 | 6/2007 | Mattlar et al. | |
| 2011/0147183 | A1 * | 6/2011 | Soininen et al. | 200/329 |
| 2011/0147185 | A1 * | 6/2011 | Soininen et al. | 200/336 |

FOREIGN PATENT DOCUMENTS

| | | | |
|---|---|---|---|
| DE | 668 433 | C | 12/1938 |
| EP | 1 443 534 | A1 | 8/2004 |
| EP | 1 053 553 | B1 | 5/2006 |
| GB | 695 380 | A | 8/1953 |
| WO | WO 90/05375 | A1 | 5/1990 |
| WO | WO 2005/069323 | A1 | 7/2005 |
| WO | WO 2005/069324 | A1 | 7/2005 |
| WO | WO 2005/076302 | A1 | 8/2005 |

OTHER PUBLICATIONS

International Search Report (PCT/ISA/210) dated Oct. 7, 2009.
Written Opinion (PCT/ISA/237) dated Oct. 7, 2009.
Finnish Search Report dated Jan. 9, 2009.

(Continued)

*Primary Examiner* — Edwin A. Leon
(74) *Attorney, Agent, or Firm* — Buchanan Ingersoll & Rooney, P.C.

(57) ABSTRACT

Exemplary embodiments are directed to a controller unit for a switching device. The controller unit includes a body part and an operating axle, which is turnable between a closed position and an open position in relation to the body part and is functionally connectable to contacts of the switching device to change respective states of the contacts between the closed position and the open position. The controller also includes a control axle that is turned by a user between an off-position and an on-position in relation to the body part and is functionally connected to turn the operating axle. A tripping assembly is functionally connected to the operating axle such that the tripping event of the tripping assembly turns the operating axle from the closed position to the open position. Connecting means selectably connect the control axle to the tripping assembly.

11 Claims, 7 Drawing Sheets

OTHER PUBLICATIONS

Soininen, Matti, et al., U.S. Appl. No. 12/971,800, entitled "Tripping Assembly for Switching Device," filed in the U. S. Patent and Trademark Office on Dec. 17, 2010.
Soininen, Matti, et al., U.S. Appl. No. 12/973,028, entitled "Controller Unit for Switching Device," filed in the U. S. Patent and Trademark Office on Dec. 20, 2010.
International Search Report (PCT/ISA/210) issued on Oct. 7, 2009, by Finnish Patent Office as the International Searching Authority for International Application No. PCT/FI2009/050512.
Written Opinion (PCT/ISA/237) issued on Oct. 7, 2009, by Finnish Patent Office as the International Searching Authority for International Application No. PCT/FI2009/050512.
Finnish Search Report dated Jan. 7, 2009, for Application No. 20085616.
International Search Report (PCT/ISA/210) issued on Oct. 7, 2009, by Finnish Patent Office as the International Searching Authority for International Application No. PCT/FI2009/050511.
Written Opinion (PCT/ISA/237) issued on Oct. 7, 2009, by Finnish Patent Office as the International Searching Authority for International Application No. PCT/FI2009/050511.
Finnish Search Report dated Jan. 12, 2009 for Application No. FI20085618.
U.S. Appl. No. 12/971,800, Soininen et al.
U.S. Appl. No. 12/973,028, Soininen et al.

* cited by examiner

CONTROLLER UNIT FOR SWITCHING DEVICE

RELATED APPLICATIONS

This application claims priority as a continuation application under 35 U.S.C. §120 to PCT/FI2009/050514, which was filed as an International Application on Jun. 12, 2009 designating the U.S., and which claims priority to Finnish Application 20085617 filed in Finland on Jun. 12, 2009. The entire contents of these applications are hereby incorporated by reference in their entireties.

FIELD

The disclosure relates to a controller, such as a controller unit for a switching device.

BACKGROUND

A switching device is a device with contact means for selectively producing an open state and a closed state in an electric circuit. The open position of the contact means is arranged to produce the open state in the electric circuit, and the closed position of the contact means is arranged to produce the closed state of the electric circuit. The controller unit of the switching device typically includes a control axle arranged to be turned by a user and functionally connected to the contact means of the switching device to change states between the open position and the closed position. The controller unit can also be provided with a tripping assembly, which is functionally connected to the contact means of the switching device in such a manner that a tripping event of the tripping assembly is able to change the state of the contact means of the switching device from the closed position to the open position. The tripping assembly can be remotely controlled by an electric signal.

An example of a switching device provided with a remote tripping assembly is disclosed in European Patent 1053553 "Remote trip mechanism of a switch device".

SUMMARY

An exemplary embodiment is directed to a controller unit for a switching device. The controller unit includes a body part and an operating axle, which is turnable between a closed position and an open position in relation to the body part and which is functionally connectable to contacts of the switching device to change respective states of the contacts between the closed position and the open position. The controller unit also includes a control axle that is turned by a user between an off-position and an on-position in relation to the body part and is functionally connected to turn the operating axle. The controller unit includes a tripping assembly, which has a trip state and a tensioned state wherein, in a tensioning event, the tripping assembly transitions from the trip state to the tensioned state and, in a tripping event, transitions from the tensioned state to the trip state, wherein the tripping assembly is functionally connected to the operating axle such that the tripping event of the tripping assembly turns the operating axle from the closed position to the open position. Connecting means selectably connect the control axle to the tripping assembly such that when the tripping assembly is in the trip state the connecting means functionally connects the control axle to the tripping assembly, which upon turning of the control axle from the off-position to the on-position causes a tensioning event of the tripping assembly, and when the tripping assembly is in the tensioned state the connecting means allows the control axle to turn freely between the on-position and the off-position while the tripping assembly remains in the tensioned state.

BRIEF DESCRIPTION OF THE DRAWINGS

The disclosure will now be described in greater detail in connection with the preferred embodiments and with reference to the accompanying drawings, in which.

DETAILED DESCRIPTION

Figure 1:
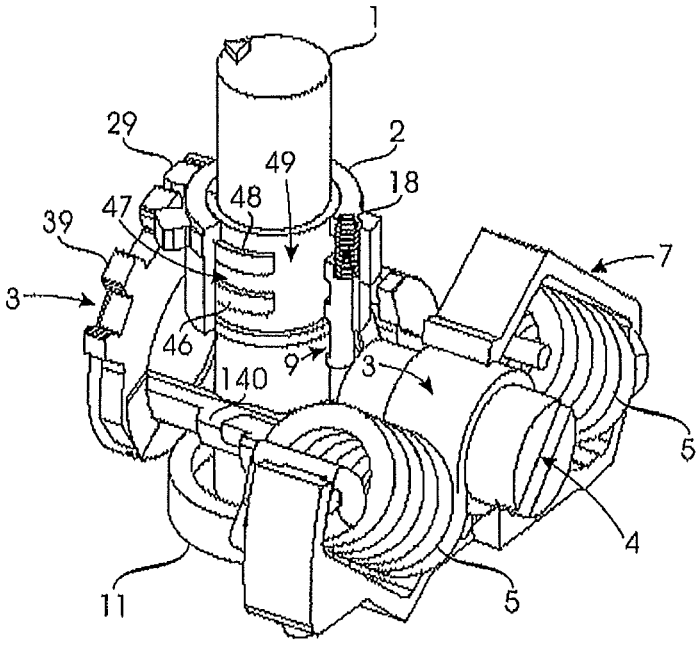
FIGS. 1 to 6 illustrate sectional views of a controller unit for a switching device in accordance with an exemplary embodiment.

It is an object of the disclosure to provide a new type of controller unit for a switching device.

A controller unit for a switching device according to the present disclosure includes a tripping assembly having a trip state and a tensioned state. When a tensioning event occurs, the tripping assembly transitions from the trip state to the tensioned state. For a tripping event, the tripping assembly switches from the tensioned state to the trip state. The tripping assembly can be arranged to be functionally connected to the contact means of the switching device such that the tripping event of the tripping assembly can change the state of the contact means of the switching device from a closed position to an open position.

FIGS. 1 to 6 illustrate sectional views of a controller unit in accordance with an exemplary embodiment. FIGS. 7A, 7B, 8A, and 8B illustrate various modes of operation of the tripping assembly in accordance with exemplary embodiments. The exemplary embodiments are described using FIGS. 7A, 7B, 8A, and 8B together with FIGS. 1 to 6 of the present disclosure.

The controller unit includes a tripping axle 3, a tripping frame 7, two tripping springs 5, an operating axle 4, a connecting member 2, a control axle 1 and connecting means. The controller unit also includes a frame spring 17 and locking means 6 and 10, shown in FIGS. 7A, 7B, 8A and 8B. A tripping event, which is described in detail below, is started by releasing the locking means 6 and 10. All components of the controller unit are mounted in a body part 200, which is illustrated in FIG. 10.

Figure 10:
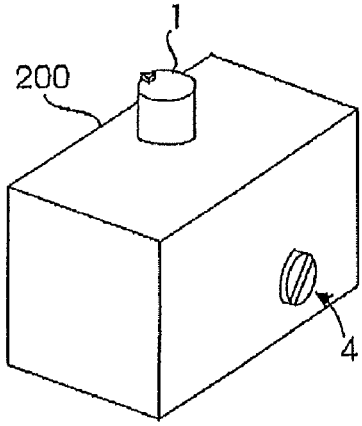
FIG. 10 illustrates the controller unit provided with a body part in accordance with an exemplary embodiment.

FIG. 10 illustrates a controller unit, provided with a body part 200 in accordance with an exemplary embodiment.

The tripping axle 3 can be arranged to turn between a trip position and a tensioned position in relation to the body part 200. The tripping frame 7 can be arranged to turn between a trip position and a tensioned position in relation to the body part 200. The operating axle 4 can be arranged to turn between an open position and a closed position in relation to the body part 200. The turning axes of the tripping axle 3, tripping frame 7, and operating axle 4 substantially converge, in that the tripping axle 3, the tripping frame 7, and the operating axle 4 are mounted on the body part in a substantially coaxial orientation.

Each tripping spring 5 is a pressure spring, one end of which can be connected to the tripping frame 7 and the other end can be connected to the tripping axle 3. Each tripping spring 5 has a non-tensioned state and a tensioned state. In the tensioned state, more energy is stored in the tripping spring 5 than in the non-tensioned state, and when the tripping spring 5 transitions from the tensioned state to the non-tensioned state, energy can be transferred to the tripping frame 7.

The frame spring 17 is a pressure spring, which can be connected between the body part 200 and the tripping frame 7 and has a non-tensioned and tensioned state.

The operating axle 4 is arranged to be connected to the main axis of the switching device such that an open position of the operating axle 4 corresponds to an open position of the contact means of the switching device and a closed position of the operating axle 4 corresponds to a closed position of the contact means. In FIGS. 1, 3, 4, 5 and 6, the operating axle 4 is in the open position and in FIG. 2 the operating axle 4 is in the closed position. The contact means of the switching device are not shown in the Figures.

The connecting member 2 is a sleeve-like member, which can be arranged to be turnable between the trip position and the tensioned position in relation to the body part. The connecting member 2 can be supported so that it is not able to move axially in relation to the body part. The connecting member 2 can be arranged to be functionally connected to the tripping axle 3 and the tripping frame 7 both in the final stage of a tensioning event and in the initial stage of a tripping event so that in these cases the tripping axle 3 and the tripping frame 7 turn in the opposite directions in relation to one another.

The connecting member 2 can be functionally connected to the tripping axle 3 through a plurality of connecting member teeth 29 and a plurality of tripping axle teeth 39 of the tripping axle 3. The connecting member 2 and the tripping axle 3 can be set to a position such that the connecting member teeth 29 and the tripping axle teeth 39 are in a cogwheel connection with one another.

The connecting member 2 can be functionally connected to the tripping frame 7 through a turn tooth 38 of the connecting member 2 and a turn projection 78 of the tripping frame 7. The connecting member 2 and the tripping frame 7 can be set to a position such that the turn tooth 38 of the connecting member and the turn projection 78 of the tripping frame 7 can transmit torque between the connecting member 2 and the tripping frame 7 in a final stage of the tensioning event and in an initial stage of the tripping event. The turn tooth 38 and the turn projection 78 are illustrated in FIGS. 7A, 7B, 8A and 8B.

The control axle 1 can be arranged to be turned 200 around its axis in relation to the body part 200. The turning axis of the control axle 1 can be perpendicular to the turning axis of the operating axle 4. The control axle 1 can be mounted coaxially to the connecting member 2. The control axis 1 has four positions: a test position, an off-position, a trip position, and an on-position. The control axle 1 is thus arranged to turn the operating axle 4 by means of an actuator 11.

The control axle 1 extends through the operating axle 4 and the turning axes of the operating axle 4 and control axle 1 intersect.

A control handle, by which the user of the switching device can manually turn the control axle 1, can be fastened to the control axle 1. Alternatively, a control motor capable of turning the control axle 1 can be connected to the control axle 1. In an exemplary embodiment, the control axle 1 can be turned through a combination of a control handle (not shown) and a control motor.

The control axle 1 and the connecting member 2 can be functionally connected to one another through connecting means. The connecting means can include a connecting pin 9, a spring 18 of the connecting pin 9, and counterpart means formed on the outer surface of the control axle 1. In an exemplary embodiment, the connecting means can be arranged to connect the control axle 1 to the connecting member 2 so that they rotate together and are coupled to one another. In another exemplary embodiment, the connecting means and the control axle can be arranged to allow the rotation of the control axle 1 and the connecting member 2 with respect to one another.

In FIGS. 1 to 6, a portion of the connecting member 2, tripping frame 7, and tripping axle 3 is cut away for better illustrating the connecting means. The tripping frame 7 can be substantially symmetrical in that the tripping frame 7 surrounds a periphery of the tripping springs 5. Accordingly, the entire connecting member 2 surrounds a periphery of the control axle 1 from all sides.

The connecting pin 9 is an elongated member, which can be mounted in a pin hole in the connecting member 2. The pin hole is parallel to the rotational axes of the control axle 1 and connecting member 2. The connecting pin 9 includes a first contact member 91 and a second contact member 92, each of which is a projection that extends radially inwards, and is arranged to cooperate with the counterpart means.

The connecting pin 9 can move axially in the pin hole between the first position and the second position in relation to the connecting member 2. Since the connecting member 2 is in an axially fixed position in relation to the control axle 1, the connecting pin 9 can also move axially between the first position and the second position in relation to the control axle 1.

The spring 18 of the connecting pin can be a helical spring, or any other suitable spring as desired, which can be arranged to exert an axial force to the connecting pin 9 to transfer the connecting pin 9 from the second position to the first position. In FIGS. 1 to 6, the first position of the connecting pin 9 at a lower position along the axis and the second position is of an upper position along the axis, whereby the spring 18 of the connecting pin is arranged to press the connecting pin 9 axially downwards. The body part can support the upper end of the spring 18 of the connecting pin, thus producing a counterforce to the force exerted by the connecting pin 9 to the spring 18 of the connecting pin.

The counterpart means can be formed on the circumference of the control axle 1, and can include guide members 42, 44, 46, 48 and a guide opening 49. The counterpart means can be arranged to cooperate with the connecting pin 9 to selectively connect the control axle 1 and the connecting member 2.

The guide members 42, 44, 46 and 48 are projections that extend in the direction of the circumference on an outer surface of the control axle 1. The guide members 42 and 44 extend axially at a distance from one another so that a guide groove 43 can be formed between them. The guide members 42 and 44 can be equal in length around the circumference of the control axle 1. The first end and second end of the guide member 42 can be at the same locations around the circumference as the first and second end of the guide member 44.

The guide members 46 and 48 can extend axially at a distance from one another so that a guide groove 47 is formed between them. The guide members 46 and 48 can be equal in length about the circumference of the control axle 1. The first end and second end of the guide member 46 can be at the same locations about the circumference of the control axle 1 as the first and second end of the guide member 48. The guide members 46 and 48 resemble each other in various aspects such that the higher guide member 48 in FIGS. 1 to 6 can be regarded as a substantial copy of the lower guide element 46.

In the direction of the circumference, the guide members 42 and 44 can be at a distance from the guide members 46 and 48 so that a guide opening 49 is formed between them. In FIGS. 1 to 6, the guide members 46 and 48 can be located clockwise to the guide opening 49, i.e. on the left-hand side of the guide opening 49, and the guide members 42 and 44 can be located counter clockwise to the guide opening 49, i.e. on the right-hand side of the guide opening 49. In the axial direction, the guide member 42 can be below the guide member 46 and the guide member 44 can be between the guide members 46 and 48.

The width of the guide member 44, i.e. the dimension parallel to the turning axis of the control axle 1, can be equal to the width of the guide member 46 and 48. The guide member 42 can be wider than the guide members 44, 46 and 48. The width of the guide groove 43 and that of the guide groove 47 substantially equal to the width of the guide members 44, 46 and 48.

Figure 9:
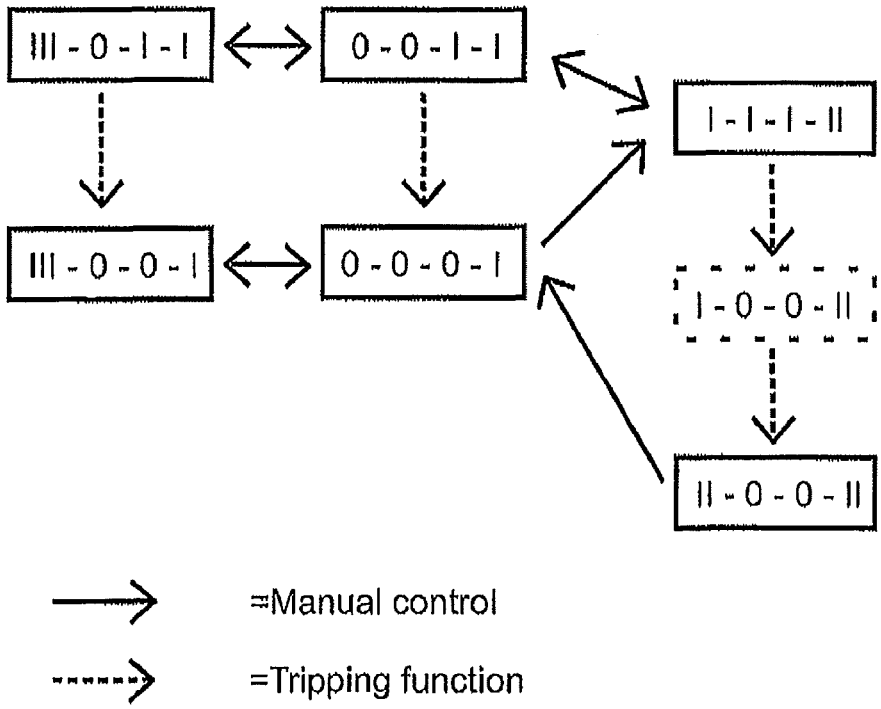
FIG. 9 illustrates a diagram in which the positions of various components of the controller unit are shown in different modes in accordance with an exemplary embodiment.

FIG. 9 illustrates a diagram in which the positions of various components of the controller unit are shown in different modes in accordance with an exemplary embodiment. In FIG. 9 the positions of the control axle 1, operating axle 4, tripping assembly, and connecting pin 9 in different exemplary modes of the controller unit, and enable the controller unit to transition between the different exemplary modes. In FIG. 9, a manual shift from one mode to another is illustrated by a continuous arrow, whereas shifts from one mode to another can be caused by a tripping event which is illustrated by discontinuous arrows. Each mode is marked with a mode code comprising four mode symbols separated by hyphens '-'.

The first mode symbol of each mode code represents the position of the control axle 1. The first mode symbol can obtain the value '0', when the control axle 1 is in the off-position, the value 'I', when the control axle 1 is in the on-position, the value 'II', when the control axle 1 is in the trip position, and the value 'III', when the control axle 1 is in the test position.

The second mode symbol represents the position of the operating axle 4. The second mode symbol can obtain the value '0', when the operating axle 4 is in the open position, and the value 'I', when the operating axle 4 is in the closed position. When the operating axle 4 is connected to the contact means of the switching device in order to control them, the value '0' of the second mode symbol corresponds to the open position of the contact means and the value 'I' corresponds to the closed position of the contact means.

The third mode symbol represents the state of the tripping assembly. The third mode symbol can obtain the value '0', when the tripping assembly is in the trip state, and the value 'I', when the tripping assembly is in the tensioned state.

When the tripping assembly is in the trip state, the frame spring 17 is in the non-tensioned state, the tripping frame 7 is in the trip position, the tripping springs 5 are in the non-tensioned state, the tripping axle 3 is in the trip position, and the connecting member 2 is in the trip position. Accordingly, when the tripping assembly is in the tensioned state, the frame spring 17 is in the tensioned state, the tripping frame 7 is in the tensioned position, the tripping springs 5 are in the tensioned state, the tripping axle 3 is in the tensioned position, and the connecting member 2 is in the tensioned position.

The fourth mode symbol represents the position of the connecting pin 9. The fourth mode symbol can obtain the value 'I', when the connecting pin 9 is in its first position, and the value 'II', when the connecting pin 9 is in its second position.

In FIG. 1, the controller unit is in an exemplary mode 0-0-0-I, whereby the control axle 1 is in the off-position, the operating axle 4 is in the open position, the tripping assembly is in the trip state, and the connecting pin 9 is in the first position.

Figure 2:
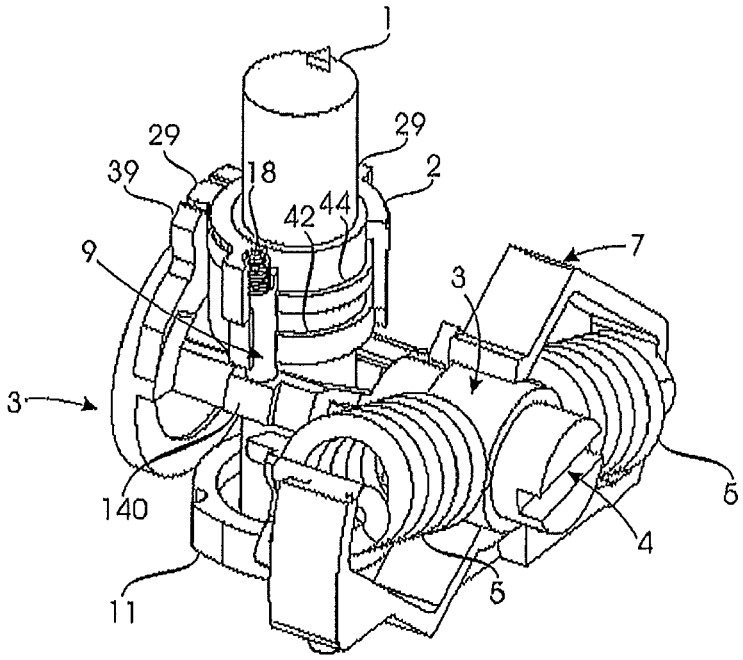

In FIG. 2, the controller unit is in an exemplary mode I-I-I-II, whereby the control axle 1 is in the on-position, the operating axle 4 is in the closed position, the tripping assembly is in the tensioned position and the connecting pin 9 is in the second position. For the tripping assembly, the shift from the mode of FIG. 1 to the exemplary mode of FIG. 2 is a tensioning event.

The shift from the exemplary mode 0-0-0-I of FIG. 1 to the exemplary mode I-I-I-II of FIG. 2 is carried out by turning the control axle ninety degrees (90°) clockwise, i.e. from the off-position to the on-position. The connecting member 2 turns with the control axle 1 ninety degrees (90°) in a clockwise, i.e. from its trip position to its tensioned position. The tripping axle 3 turns from its trip position to its tensioned position due to the cogwheel connection between the connecting member teeth 29 and the tripping axle teeth 39.

During the initial stage of the tensioning event, the tripping frame 7 tends to rotate clockwise with the tripping axle 3, because the tripping axle 3 applies a torque to the tripping frame 7 via the tripping springs 5. The tripping frame 7 is not allowed to rotate clockwise from its trip position, because the body part 200 prevents the tripping frame from rotating clockwise by exerting a supporting force to it. The tripping axle 3 turns in relation to the tripping frame 7, and the tripping springs 5 are compressed.

During the final stage of the tensioning event, the tripping frame 7 turns counter clockwise from its trip position to its tensioned position, thus pressing the frame spring 17 to the tensioned state. The tripping axle 3 and the tripping frame 7 turn in opposite directions with respect to one another. The tripping frame 7 turns to the tensioned position as a result of the cooperation of the turn tooth 38 in the connecting member 2 and the turn projection 78 in the tripping frame 7. The turn tooth 38 and the turn projection 78 are illustrated in FIGS. 7A, 7B, 8A and 8B.

During the tensioning event, the tripping springs 5 transition from the non-tensioned state to the tensioned state. When the tripping springs transition from their respective non-tensioned states to their respective tensioned states, they pass by a respective dead point where each spring does not tend to turn the tripping axle 3 in relation to the tripping frame 7. In the tensioned state, each tripping spring 5 can turn the tripping axle 3 clockwise and the tripping frame 7 counter clockwise. The tensioned state of each the tripping spring 5 is close to the dead point, wherein the torque exerted by the tripping springs 5 on the tripping axle 3 and the tripping frame 7 are relatively small.

In an exemplary embodiment, the tripping springs can be arranged such that the tensioned state is at the dead point. In another exemplary embodiment, the tripping springs are in their tensioned state and are arranged to be on that side of their dead point where they can turn the tripping axle towards its trip position.

Figure 3:
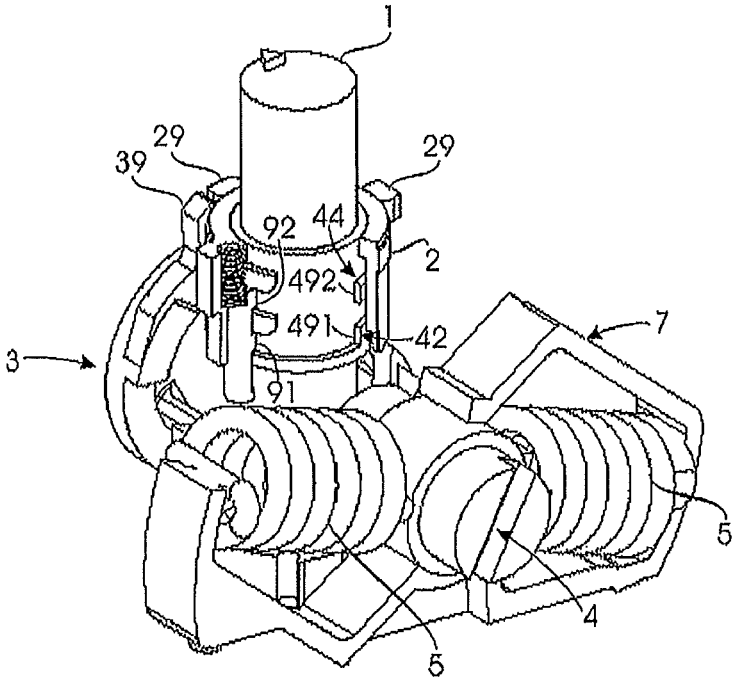
Figure 4:
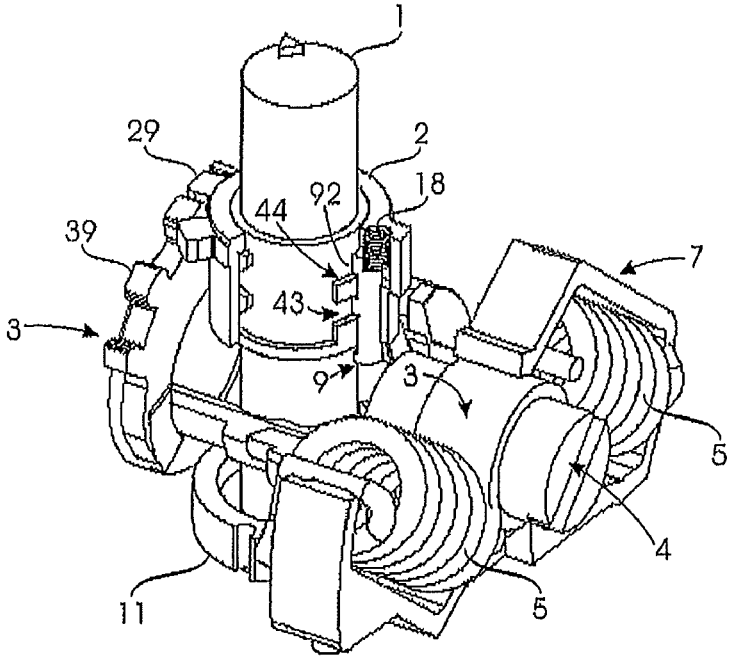

As described above, the connecting member 2 turns along with the control axle 1 when the mode changes from 0-0-0-I to I-I-I-II. The connecting member 2 turns with the control axle 1 as a result of the cooperation of the first contact member 91 and the second contact member 92 of the connecting pin with counter surfaces 491 and 492. The first counter surface 491 and the second counter surface 492 are illustrated in FIGS. 3 and 4. The first counter surface 491 can be formed by the perimetral end of the guide member 42, and the second counter surface 492 can be formed by the perimetral end of the guide member 44.

When the control axle 1 is turned from the off-position to the on-position, the operating axle 4 turns from its open position to the closed position by means of the actuator 11. As illustrated in FIG. 2, when the operating axle 4 turns from the open position to the closed position the operating axle 4, is in contact with the connection pin 9 by means of a pin transferring projection 140 in order for the operating axle 4 to transition from the first position to the second position. At some time before the operating axle 4 reaches its closed position, the pin transferring projection 140 touches the lower surface of the connecting pin 9 and lifts the connecting pin 9 to its upper position while the operating axle 4 reaches its closed position.

The movement of the connecting pin 9 from its first position to its second position by being pushed by the pin transferring projection 140 of the operating axle 4 is possible, because the connecting pin 9 is located at the guide opening 49. The guide opening 49 allows the axial movement of the connecting pin 9 between the first and the second position.

The shift from the exemplary mode I-I-I-II illustrated in FIG. 2 to the mode 0-0-I-I illustrated in FIG. 3 is carried out by turning the control axle 1 ninety degrees (90°) counter clockwise, i.e. from the on-position to the off-position. The tripping assembly remains in its tensioned state, and thus the connecting member 2 also remains in its tensioned position and turns 90° clockwise in relation to the control axle 1. The operating axle 4 turns to the open position and the connecting pin 9 moves to the first position. The connecting pin 4 moves to the first position, because the pin transferring projection 140 of the operating axle 4 no longer exerts force on the lower end of the connecting pin 9, whereby the spring 18 of the connecting pin presses the connecting pin 9 to its lower position. As shown in FIG. 3, the exemplary mode 0-0-I-I, the connecting pin 9 is no longer at the guide opening 49 but at the guide members 46 and 48, and the second contact member 92 is in the guide groove 47. The connecting pin 9 has moved to its first position while the connecting pin 9 is still at the guide opening 49.

The shift from the exemplary mode I-I-I-II of FIG. 2 to the exemplary mode II-0-0-II of FIG. 4 is due to a tripping event. The frame spring 17 transitions from the tensioned state to the non-tensioned state and turns the tripping frame 7 from the tensioned position to the trip position. During an initial stage of the tripping event, the tripping axle 3 is forced to turn to the direction opposite to that of the tripping frame 7 by the connecting member 2. And the turn projection 78 of the tripping frame transmits torque to the connecting member 2 via the turn tooth 38, and the connecting member 2 transmits the torque to the tripping axle 3 by means of the cogwheel connection between the connecting member 2 and the tripping axle 3. The turn tooth 38 and the turn projection 78 are shown in FIGS. 7A, 7B, 8A and 8B.

In the beginning of the tripping event the role of the connecting member 2 is significant, because it makes the tripping axle 3 turn in relation to the tripping frame 7 to the extent that the tripping springs 5 transition to the other side of their respective dead points. Each spring 5 transitions so far from the dead point that the tripping springs 5 are able to turn the tripping axle 3 to its trip position.

Figure 11:
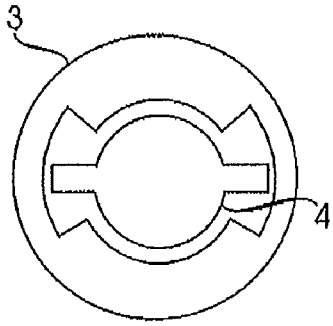
FIG. 11 illustrates a functional connection between a tripping axle and an operating axle in accordance with an exemplary embodiment.

During the tripping event, the tripping axle 3 turns the operating axle 4 directly by means of the functional connection between the tripping axle 3 and the operating axle 4. Force is thus not transmitted from the tripping axle 3 to the operating axle 4 via the control axle 1. The functional connection between the tripping axle 3 and the operating axle 4 can be arranged such that when the tripping axle 3 is in the tensioned position, the operating axle 4 can freely turn between the open position and the closed position without a turn of the tripping axle 3. An exemplary functional connection between the tripping axle 3 and the operating axle 4 is shown in FIG. 11.

When the exemplary mode I-I-I-II changes to exemplary mode II-0-0-II, the control axle 1 turns to the trip position, which is between the on-position and the off-position. The trip position of the control axle 1 is thus 45° counter clockwise to the on-position and 45° clockwise to the off-position.

The control axle 1 is turned to the trip position by the operating axle 4 via the actuator 11. No torque is transmitted between the connecting member 2 and the control axle 1 when the mode changes from I-I-I-II to II-0-0-II, because in this mode shift the first contact member 91 of the connecting pin 9 glides in the guide groove 43 and the second contact member 92 of the connecting pin 9 glides on the upper surface of the guide member 44.

The shift from the exemplary mode II-0-0-II shown in FIG. 4 to the exemplary mode 0-0-0-I shown in FIG. 1 is carried out by turning the control axle 1 forty-five degrees (45°) counter clockwise, i.e. from the trip position to the off-position. The turning of the control axle 1 from the trip position to the off-position has no effect on the position of the operating axle 4 or the state of the tripping assembly. Instead, the connecting pin 9 transfers from its second position to its first position after reaching the guide opening 49.

The shift from the exemplary mode 0-0-I-I of FIG. 3 to the exemplary mode 0-0-0-I of FIG. 1 is caused by a tripping event. For the tripping assembly, such a shift between the modes is identical with the shift between the exemplary modes I-I-I-II and II-0-0-II. The control axle 1 remains in its off-position and the connecting member 2 turns 90° counter clockwise to the control axle 2. The connecting pin 9 remains in its first position.

Figure 5:
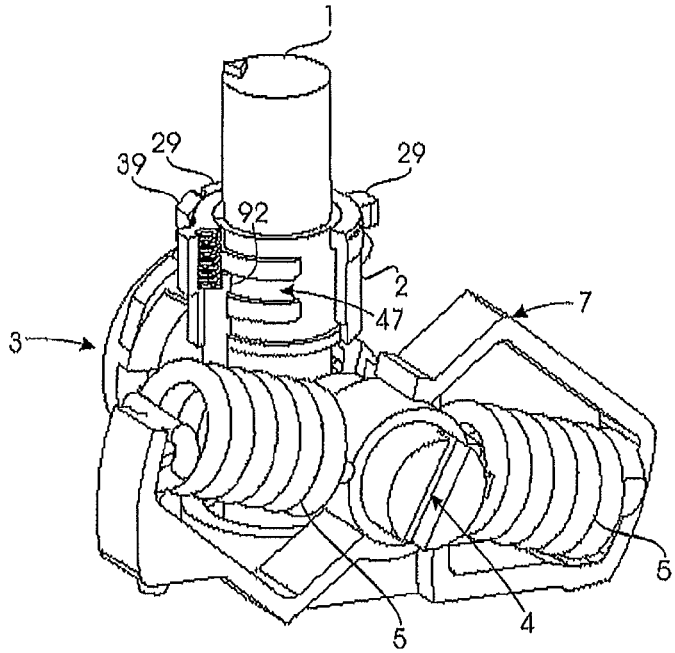

The shift from the exemplary mode 0-0-I-I shown in FIG. 3 to the exemplary mode III-0-I-I shown in FIG. 5 is carried out by turning the control axle 1 forty-five degrees (45°) counter clockwise from the off-position, whereupon the control axle 1 reaches the test position. This mode shift has no effect on the position of the operating axle 4 or the state of the tripping assembly. The connecting member 2 turns 45° clockwise in relation to the control axle 1 as the second contact member 92 of the connecting pin 9 glides in the guide groove 47.

Figure 6:
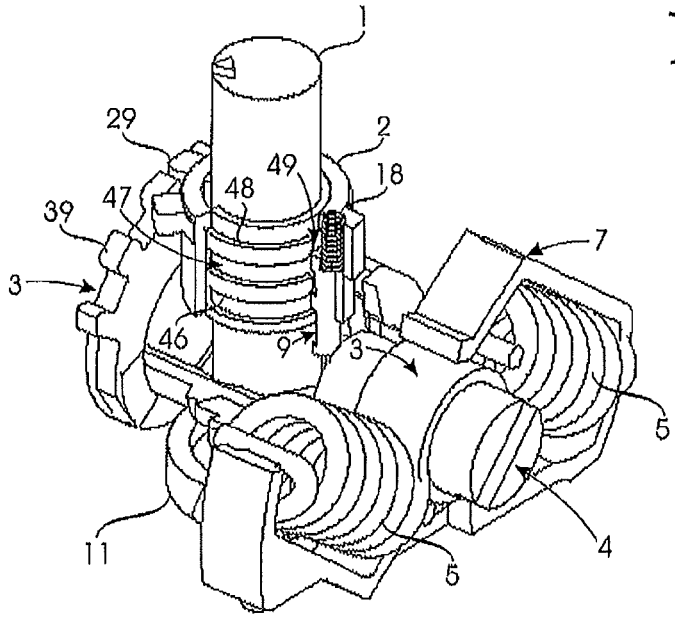

The shift from the exemplary mode III-0-I-I of FIG. 5 to the exemplary mode III-0-0-I of FIG. 6 is caused by a tripping event. For the tripping assembly, such a shift between the modes is identical with the shift between the modes I-I-I-II and II-0-0-II. The control axle 1 remains in its test position and the connecting member 2 turns 90° counter clockwise to it. The connecting pin 9 remains in its first position.

The shift from the exemplary mode III-0-0-I of FIG. 6 to the exemplary mode 0-0-0-I of FIG. 1 is carried out by turning the control axle 1 forty-five degrees (45°) clockwise, whereupon the control axle 1 reaches the off-position. This mode shift has no effect on the position of the operating axle 4 or the state of the tripping assembly. The connecting member 2 turns 45° counter clockwise to the control axle 1. The connecting pin 9 is in the guide opening 49 during the of the mode shift.

It should be readily apparent that the shift from the mode 0-0-0-I to the exemplary mode III-0-0-I occurs in reverse order as the shift from the exemplary mode III-0-0-I to the exemplary mode 0-0-0-I. Accordingly, the shift from the exemplary mode 0-0-I-I to the exemplary mode I-I-I-II occurs in reverse order as the shift from the exemplary mode I-I-I-II to the exemplary mode 0-0-I-I, and the shift from the exemplary mode III-0-I-I to the exemplary mode 0-0-I-I occurs in reverse order as the shift from the exemplary mode 0-0-I-I to the exemplary mode III-0-I-I. The reciprocity of these three mode shifts is illustrated in the diagram of FIG. 9 by bidirectional arrows.

When the control axle 1 is in the test position as shown in FIGS. 5 and 6, a test function of the switching device can be achieved.

The exemplary mode I-0-0-II illustrated in the diagram of FIG. 9 is an unstable state, which can occur when the user holds the handle of the control axle 1 during the tripping event. When the user lets go of the handle, the control axle 1 turns to its trip position, forced by a spring (not shown).

The controller unit illustrated in FIGS. 1 to 6 and 10 is a modular controller unit of the switching device. In addition to a controller module, the modular switching device can include one or more contact modules (not shown), which include the contact means of the switching device. Forces that change the state of the contact means can be transmitted from the controller module to one or more contact modules by means of the operating axle 4.

In the modular switching device, the controller unit and each contact module can include individual body parts. In an exemplary embodiment, the controller unit of the disclosure can be used in an integrated switching device, in which the controller unit can be mounted in the same body part as the contact means.

Figure 7A:
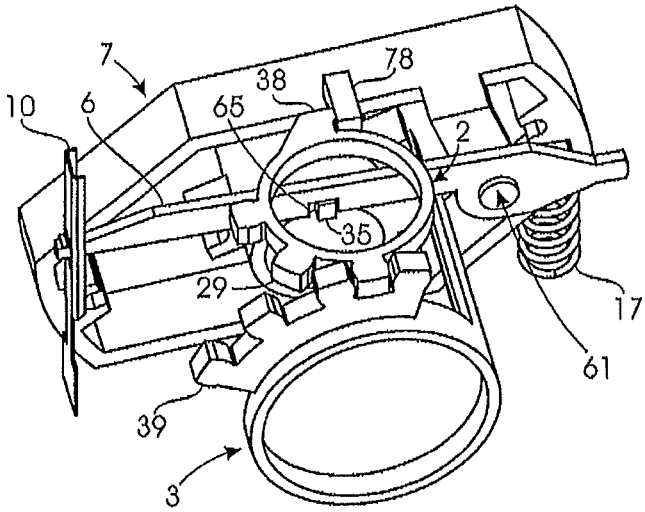
FIGS. 7A and 7B illustrate a tripping assembly of the controller unit in a tensioned state in accordance with an exemplary embodiment.
Figure 7B:
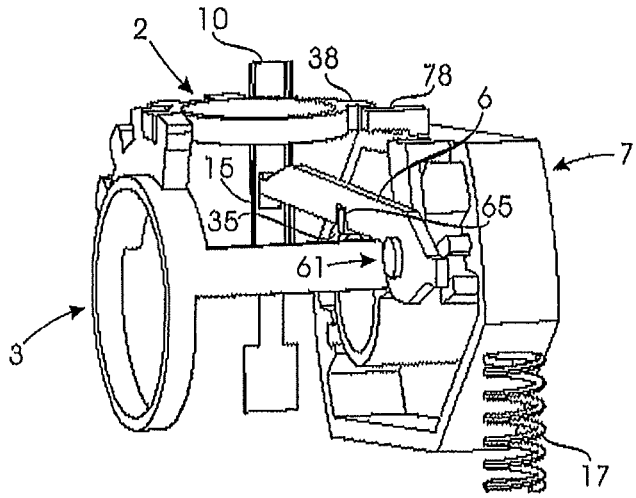
Figure 8A:
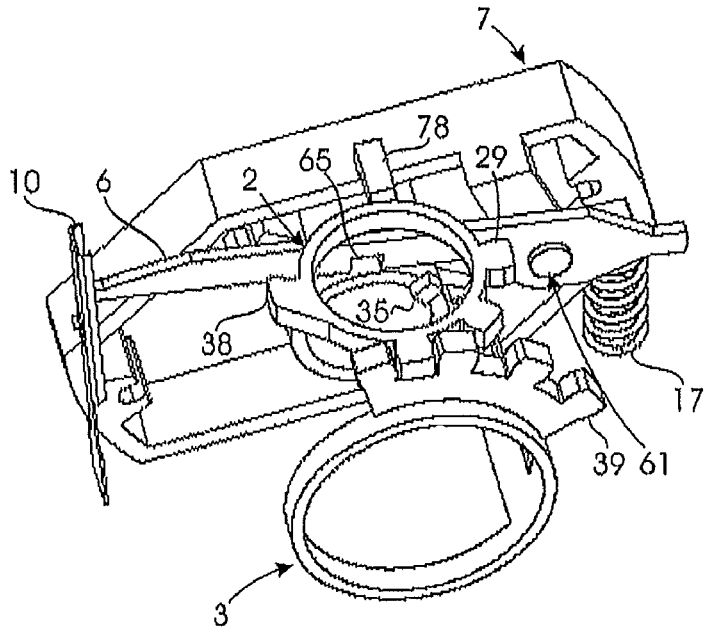
FIGS. 8A and 8B illustrate a tripping assembly of the controller unit in a trip state in accordance with an exemplary embodiment.
Figure 8B:
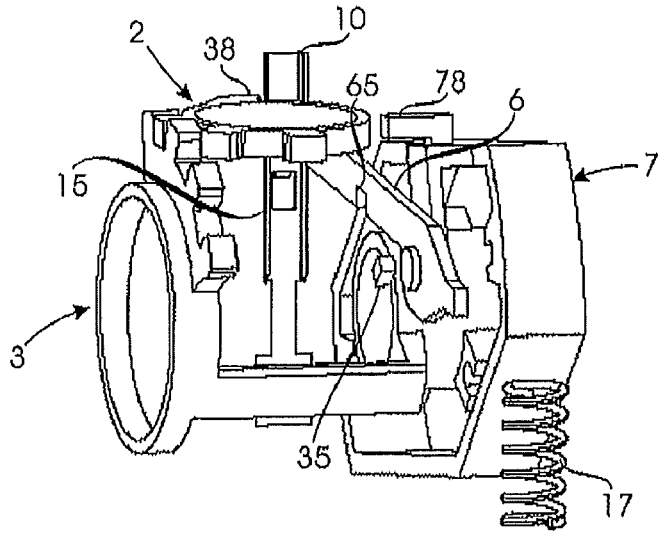

The exemplary tripping assembly shown in FIGS. 7A, 7B, 8A, and 8B operates in the same manner as the tripping assembly shown in FIGS. 1 to 6. In FIGS. 7A and 7B, the tripping assembly is in a tensioned state, its mode corresponding to that of the tripping assembly of the controller units shown in FIGS. 2, 3, and 5. In FIGS. 8A and 8B, the tripping assembly is in a trip state, its mode corresponding to that of the tripping assembly of the controller units shown in FIGS. 1, 4, and 6. The shift from the situation of FIGS. 7A and 7B to the situation of FIGS. 8A and 8B is caused by a tripping event.

The exemplary tripping assembly of FIGS. 7A, 7B, 8A, and 8B includes a tripping axle 3, a tripping frame 7, a frame spring 17, a connecting member 2, and locking means. The tripping assembly can also include two tripping springs (not shown), the location and operation of which are identical with the tripping springs of the controller unit according to FIGS. 1 to 6.

The exemplary tripping assembly of FIGS. 7A, 7B, 8A, and 8B is arranged to be connected to the main axis (not shown) of the switching device by means of the tripping axle 3. The tensioning of the tripping assembly can be carried out by turning the main axis of the switching device to the closed position. In the tripping event, respectively, the tripping axle 3 turns the main axis of the switching device via the functional connection between the tripping axle 3 and the main axis of the switching device. The functional connection between the tripping axle and the main axis of the switching device can be fixed, or can be arranged to be similar to the functional connection between the tripping axle 3 and the operating axle 4, shown in FIG. 11. When the tripping axle is in the tensioned position, the main axis of the switching device can freely turn between the open position and the closed position without the tripping axle needing to turn. The tripping assembly of FIGS. 7A to 8B can be mounted in any switching device with a main axis.

The locking means can have a locking state and a trip state. In the locking state as shown in FIGS. 7A and 7B, the locking means locks the tripping assembly to the tensioned state. The tripping event can be started by releasing the locking means so that the tripping assembly is allowed to shift from its tensioned state to the trip state. When the tripping event ends, the locking means are in the trip state as shown in FIGS. 8A and 8B.

The locking means includes a locking lever 6 and a locking clamp 10, each of which has a locking position and a trip position. When the locking means are in the locking state, the locking lever 6 and the locking clamp 10 are in the locking position. When the locking means are in the trip state, the locking lever 6 and the locking clamp 10 are in the trip position.

The locking lever 6 can be an elongated member, which is pivoted at a pivot point 61 to the tripping frame 7 such that the turning axis of the locking lever 6 is parallel to the turning axis of the tripping frame 7 and is located at a distance therefrom. The locking lever 6 has a longer lever arm part extending from the pivot point 61 of the locking lever towards the locking clamp 10, and a shorter lever arm part extending from the pivot point 61 of the locking lever away from the locking clamp 10.

In the locking state of the locking means, a first and a second supporting force are exerted to the locking lever 6, the cooperation of which prevents the locking lever 6 from rotating about the pivot point 61 of the locking lever and in relation to the body part. The first supporting force is exerted by the body part on the shorter lever arm part of the locking lever 6, and the second supporting force is exerted by the locking clamp 10 close to the distal end of the longer lever arm part of the locking lever 6.

In its locking position, the locking clamp 10 can be arranged to hold the locking lever 6 in the locking position of the locking lever and, when released, to allow the movement of the locking lever 6 from the locking position of the locking lever to the trip position of the locking lever. The locking clamp 10 can include an elongated rectangular member, the first axial end of which is fixedly connected to the body part. When the locking clamp 10 is in the locking position, it is substantially perpendicular to both the locking lever 6 and the turning axis of the locking lever 6. The locking clamp 10 can include a clamp opening 15, which receives the distal end of the longer lever arm part of the locking lever 6 when the locking means are in the locking state. The clamp opening 15 is on a side of the longitudinal middle point of the locking clamp 10 which is closer to the second axial end. The locking clamp 10 exerts said second supporting force on the locking lever 6 via the rim of the clamp opening 15.

In the tripping event, a shift to the trip state of the locking means can be carried out by moving the second axial end of the locking clamp 10 away from the pivot point 61 of the locking lever such that the distal end of the longer lever arm part of the locking lever 6 is no longer received in the clamp opening 15. As a result, the locking clamp 10 does not exert the second supporting force close to the distal end of the longer lever arm part of the locking lever 6, thus allowing the locking lever 6 to rotate about the pivot point 61. The rotation of the locking lever 6 about the pivot point 61 allows, for its part, the turning of the tripping frame 7 from its tensioned position to its trip position.

The locking lever 6 can include a locking slot 65 arranged to cooperate with a locking projection 35 provided at the tripping axle 3. When the locking lever 6 is in the locking position, the locking projection 35 is in the locking slot 65, and the cooperation of the locking projection 35 and the locking slot 65 prevents the tripping axle 3 from turning away from the tensioned position. When the locking lever 6 is in the trip position, the locking projection 35 and the locking slot 65 do not cooperate, and thus the locking lever 6 allows the tripping axle 3 to turn to the trip position.

In an exemplary embodiment the locking clamp 10 can be arranged to be manually transferred from the locking position to the trip position by a movable knob. In another embodiment, the locking clamp 10 can be arranged to be transferred from the locking position to the trip position by means of a solenoid.

The transfer of the locking clamp 10 from the locking position to the trip position requires little force, since the locking clamp 10 is located far from the pivot point 61 of the locking lever. The locking means can utilize a lever arm.

The small amount of force required for using the locking clamp 10 can be advantageous for embodiments, in which the locking clamp 10 is arranged to be transferred from the locking position to the trip position by means of a solenoid. For safety reasons, the solenoid can be arranged to operate according to the holding current principle, which means that holding current can be supplied to the solenoid all the time in order to keep the locking clamp 10 in the locking position. The smaller the specified force for using the locking clamp 10, the smaller the required holding current.

It is obvious to a person skilled in the art that the basic idea of the disclosure may be implemented in many different ways. The disclosure and its embodiments are thus not restricted to the above examples, but may vary within the scope of the claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the fore-going description and all changes that come within the meaning and range and equivalence thereof are intended to be embraced therein.

The invention claimed is:

1. A controller unit for a switching device, the controller unit comprising:

a body part;

an operating axle, which is turnable between a closed position and an open position in relation to the body part and which is functionally connectable to contacts of the switching device to change respective states of the contacts between the closed position and the open position;

a control axle that is turned by a user between an off-position and an on-position in relation to the body part and is functionally connected to turn the operating axle;

a tripping assembly, which has a trip state and a tensioned state wherein, in a tensioning event, the tripping assembly transitions from the trip state to the tensioned state and, in a tripping event, transitions from the tensioned state to the trip state, wherein the tripping assembly is functionally connected to the operating axle such that the tripping event of the tripping assembly turns the operating axle from the closed position to the open position, and connecting means which selectably connect the control axle to the tripping assembly such that when the tripping assembly is in the trip state the connecting means functionally connects the control axle to the tripping assembly, which upon turning of the control axle from the off-position to the on-position causes a tensioning event of the tripping assembly, and when the tripping assembly is in the tensioned state the connecting means allows the control axle to turn freely between the on-position and the off-position while the tripping assembly remains in the tensioned state.

2. The controller unit of claim 1, wherein the tripping assembly comprises a connecting member which is mounted coaxially to the control axle and is turnable between a trip position and a tensioned position in relation to the body part, whereby the trip position of the connecting member corresponds to the trip state of the tripping assembly and the tensioned position of the connecting member corresponds to the tensioned state of the tripping assembly.

3. The controller unit of claim 2, wherein the connecting means comprises:

a connecting pin mounted on the connecting member and axially transferable between a first position and a second position in relation to the connecting member such that during the tensioning event, the power transmission from the control axle to the tripping assembly is performed by the connecting pin in the first position, and counterpart means formed on the circumference of the control axle and arranged to cooperate with the connecting pin to selectively connect the control axle and the tripping assembly.

4. The controller unit of claim 3, wherein when the operating axle turns from the open position to the closed position, the operation axle contacts the connecting pin to transfer the connecting pin from the first position to the second position.

5. The controller unit of claim 3, wherein the connecting means comprises: a spring, which is arranged to exert a force on the connecting pin, to transfer the connecting pin from the second position to the first position.

6. The controller unit of claim 5, wherein the counterpart means comprises a plurality of guide members and a guide opening, wherein each guide member is a projection in the direction of the circumference and protrudes from the outer surface of the control axle, wherein each guide member is arranged to prevent axial movement of the connecting pin when the connecting pin is located at the respective guide member in the direction of the circumference, and wherein the guide opening is arranged to allow the axial movement of the connecting pin between the first and the second positions when the connecting pin is located at the guide opening, in the direction of the circumference.

7. The controller unit of claim 6, wherein the perimetral end of at least one guide member forms a counter surface, which is arranged to be in contact with the connecting pin during the tensioning event to transmit a tensioning force from the control axle to the connecting member.

8. The controller unit of claim 4, wherein the connecting means comprises a spring, which is arranged to exert a force on the connecting pin, to transfer the connecting pin from the second position to the first position.

9. A controller unit for a switching device, comprising:

a body part;

an operating axle, which is turnable between a closed position and an open position in relation to the body part and is functionally connectable to contacts of the switching device to change respective states of the contacts between the closed position and the open position;

a control axle that is turned by a user between an off-position and an on-position in relation to the body part and is functionally connected to turn the operating axle;

a tripping assembly that is functionally connected to the operating axle such that the tripping event of the tripping assembly turns the operating axle from the closed position to the open position, and connecting means which selectably connect the control axle to the tripping assembly.

10. The controller unit of claim 9, wherein when the tripping assembly is in the trip state the connecting means functionally connects the control axle to the tripping assembly, which upon turning of the control axle from the off-position to the on-position causes a tensioning event of the tripping assembly, and when the tripping assembly is in the tensioned state the connecting means allows the control axle to turn freely between the on-position and the off-position while the tripping assembly remains in the tensioned state.

11. The controller unit of claim 9, wherein the tripping assembly has a trip state and a tensioned state, wherein in a tensioning event, the tripping assembly transitions from the trip state to the tensioned state and, in a tripping event, transitions from the tensioned state to the trip state.

* * * * *